US011047241B2

(12) United States Patent
Gayman et al.

(10) Patent No.: US 11,047,241 B2
(45) Date of Patent: Jun. 29, 2021

(54) GAS TURBINE ENGINE AIRFOIL HAVING SERPENTINE FED PLATFORM COOLING PASSAGE

(71) Applicant: United Technologies Corporation, Farmington, CT (US)

(72) Inventors: Scott W. Gayman, Manchester, CT (US); Brandon W. Spangler, Vernon, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 645 days.

(21) Appl. No.: 15/022,622

(22) PCT Filed: Sep. 12, 2014

(86) PCT No.: PCT/US2014/055332
§ 371 (c)(1),
(2) Date: Mar. 17, 2016

(87) PCT Pub. No.: WO2015/080783
PCT Pub. Date: Jun. 4, 2015

(65) Prior Publication Data

US 2016/0230567 A1 Aug. 11, 2016

Related U.S. Application Data

(60) Provisional application No. 61/879,736, filed on Sep. 19, 2013.

(51) Int. Cl.
*F01D 5/18* (2006.01)

(52) U.S. Cl.
CPC ..... *F01D 5/187* (2013.01); *F05D 2240/81* (2013.01); *F05D 2250/185* (2013.01)

(58) Field of Classification Search
CPC ..... F01D 5/181; F01D 5/187; F05D 2240/81; F05D 2250/185
See application file for complete search history.

(56) References Cited

U.S. PATENT DOCUMENTS 5,344,283 A 9/1994 Magowan et al.
5,382,135 A 1/1995 Green
(Continued)

FOREIGN PATENT DOCUMENTS

EP 1205634 5/2002
EP 1813776 A2 8/2007
EP 2022941 2/2009

OTHER PUBLICATIONS

International Preliminary Report on Patentability for PCT Application No. PCT/US2014/055332 dated Mar. 31, 2016.
(Continued)

*Primary Examiner* — Courtney D Heinle
*Assistant Examiner* — Danielle M. Christensen
(74) *Attorney, Agent, or Firm* — Carlson, Gaskey & Olds, P.C.

(57) ABSTRACT

A gas turbine engine airfoil includes a platform, and spaced apart walls that provide an exterior airfoil surface that extends radially from the platform to an end opposite the platform. A serpentine cooling passage is arranged between the walls and has a first passageway that extends from the platform toward the end and a second passageway fluidly connecting to the first passageway and extending from the end toward the platform to an end. A platform cooling passageway is fluidly connected to the end and extends transversely into the platform. A cooling hole fluidly connects the platform cooling passageway to an exterior surface.

7 Claims, 4 Drawing Sheets

(56) References Cited

U.S. PATENT DOCUMENTS

| | | | | |
|---|---|---|---|---|
| 5,813,835 | A | 9/1998 | Corsmeier et al. | |
| 6,079,946 | A | 6/2000 | Suenaga et al. | |
| 7,255,536 | B2 | 8/2007 | Cunha et al. | |
| 7,845,907 | B2 * | 12/2010 | Pietraszkiewicz | F01D 5/186 416/97 R |
| 8,079,814 | B1 * | 12/2011 | Liang | F01D 5/187 415/115 |
| 8,133,024 | B1 | 3/2012 | Liang | |
| 8,734,108 | B1 * | 5/2014 | Liang | F01D 5/189 416/96 A |
| 2009/0202339 | A1 | 8/2009 | Torii et al. | |
| 2012/0034102 | A1 | 2/2012 | Boyer | |
| 2012/0107135 | A1 | 5/2012 | Harris, Jr. et al. | |
| 2012/0230838 | A1 * | 9/2012 | Hada | F01D 5/187 416/97 R |
| 2013/0052009 | A1 * | 2/2013 | Smith | F01D 5/186 416/1 |
| 2013/0115101 | A1 * | 5/2013 | Walunj | F01D 5/186 416/97 R |
| 2013/0171003 | A1 | 7/2013 | Ellis et al. | |
| 2018/0363467 | A1 * | 12/2018 | Molter | B23P 15/02 |

OTHER PUBLICATIONS

The Supplementary European Search Report for EP Application No. 14865153.2, dated May 10, 2017.

International Search Report and Written Opinion for International Application No. PCT/US2014/055332 dated Jun. 19, 2015.

* cited by examiner

GAS TURBINE ENGINE AIRFOIL HAVING SERPENTINE FED PLATFORM COOLING PASSAGE

CROSS-REFERENCE TO RELATED APPLICATIONS

This application claims priority to U.S. Provisional Application No. 61/879,736, which was filed on Sep. 19, 2013 and is incorporated herein by reference.

BACKGROUND

This disclosure relates to a gas turbine engine airfoil. More particularly, the disclosure relates to a cooling configuration in the airfoil.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections may include alternating series of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes, which generally do not rotate, guide the airflow and prepare it for the next set of blades.

Many turbine blades having turns that provide a serpentine shape, which create undesired pressure losses. Some turbine blades use internally cored serpentine cavities to cool the mid-body section of the airfoil between the leading and trailing edges. The cooling flow is fed into a serpentine passage from the root of the blade. Most serpentine configurations use three to five passageways with the last passageway flowing radially outward from the root and finally terminating near the tip. If cooling air does not reach the tip of the last passage, the airfoil could develop a hot spot and burn through. Having the last passageway flow radially outward takes advantage of pumping action from the circumferential forces on the turbine blade, which ensures cooling air reaches the tip of the last passage.

SUMMARY

In one exemplary embodiment, a gas turbine engine airfoil includes a platform, and spaced apart walls that provide an exterior airfoil surface that extends radially from the platform to an end opposite the platform. A serpentine cooling passage is arranged between the walls and has a first passageway that extends from the platform toward the end and a second passageway fluidly connecting to the first passageway and extending from the end toward the platform to an end. A platform cooling passageway is fluidly connected to the end and extends transversely into the platform. A cooling hole fluidly connects the platform cooling passageway to an exterior surface.

In a further embodiment of the above, multiple cooling passages extend radially within the airfoil and are spaced apart from one another in a chord-wise direction.

In a further embodiment of any of the above, the multiple passages include a leading edge passage that is arranged near a leading edge of the exterior airfoil surface.

In a further embodiment of any of the above, the multiple passages include a trailing edge passage that is arranged near a trailing edge of the exterior airfoil surface.

In a further embodiment of any of the above, each of the multiple passages includes discrete inlets that provide cooling flow to the passage.

In a further embodiment of any of the above, the first and second passageways provide an up-pass passageway and a down-pass passageway that form a U-shaped cooling passage.

In a further embodiment of any of the above, the serpentine cooling passage includes a third passageway that is fluidly connected to the second passageway and extends from the platform toward the end.

In a further embodiment of any of the above, the serpentine cooling passage terminates at the end.

In a further embodiment of any of the above, the platform cooling passageway extends along a pressure side of the platform.

In a further embodiment of any of the above, the platform cooling passageway extends along a suction side of the platform.

In a further embodiment of any of the above, the platform cooling passageway extends along a pressure side and a suction side of the platform.

In a further embodiment of any of the above, multiple cooling holes fluidly connect the platform cooling passageway to the exterior surface.

In another exemplary embodiment, a core for a gas turbine engine airfoil includes a serpentine core portion that is configured to provide an inlet that extends to a first passageway. A second passageway is fluidly connected to the first passageway to form a U-shaped cooling passage. A platform core portion is configured to provide a platform cooling passageway that is arranged transverse and connected to the second passageway.

In a further embodiment of the above, the first passageway is an up-pass passageway and the second passageway is a down-pass passageway. The down-pass passageway terminates near the platform cooling passageway.

In a further embodiment of any of the above, the first passageway is an up-pass passageway and the second passageway is a down-pass passageway. The platform cooling passageway is generally normal to the down-pass passageway.

In a further embodiment of any of the above, the platform core portion extends in the opposite directions from the serpentine core portion.

In another exemplary embodiment, a method of cooling an airfoil comprising the steps of supplying a cooling fluid to an airfoil in a radial direction toward an end, turning the cooling fluid from the end back toward the root to a region near a platform, conveying the cooling fluid from the region to the platform and exiting the cooling fluid through a cooling hole to an exterior surface.

In a further embodiment of the above, the supplying step includes providing the cooling fluid through multiple discrete inlets to multiple cooling passages.

In a further embodiment of any of the above, the turning step includes flowing the cooling fluid along a U-shaped serpentine cooling passage.

In a further embodiment of any of the above, the conveying step includes conveying the cooling fluid to the platform on opposite sides of an airfoil.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
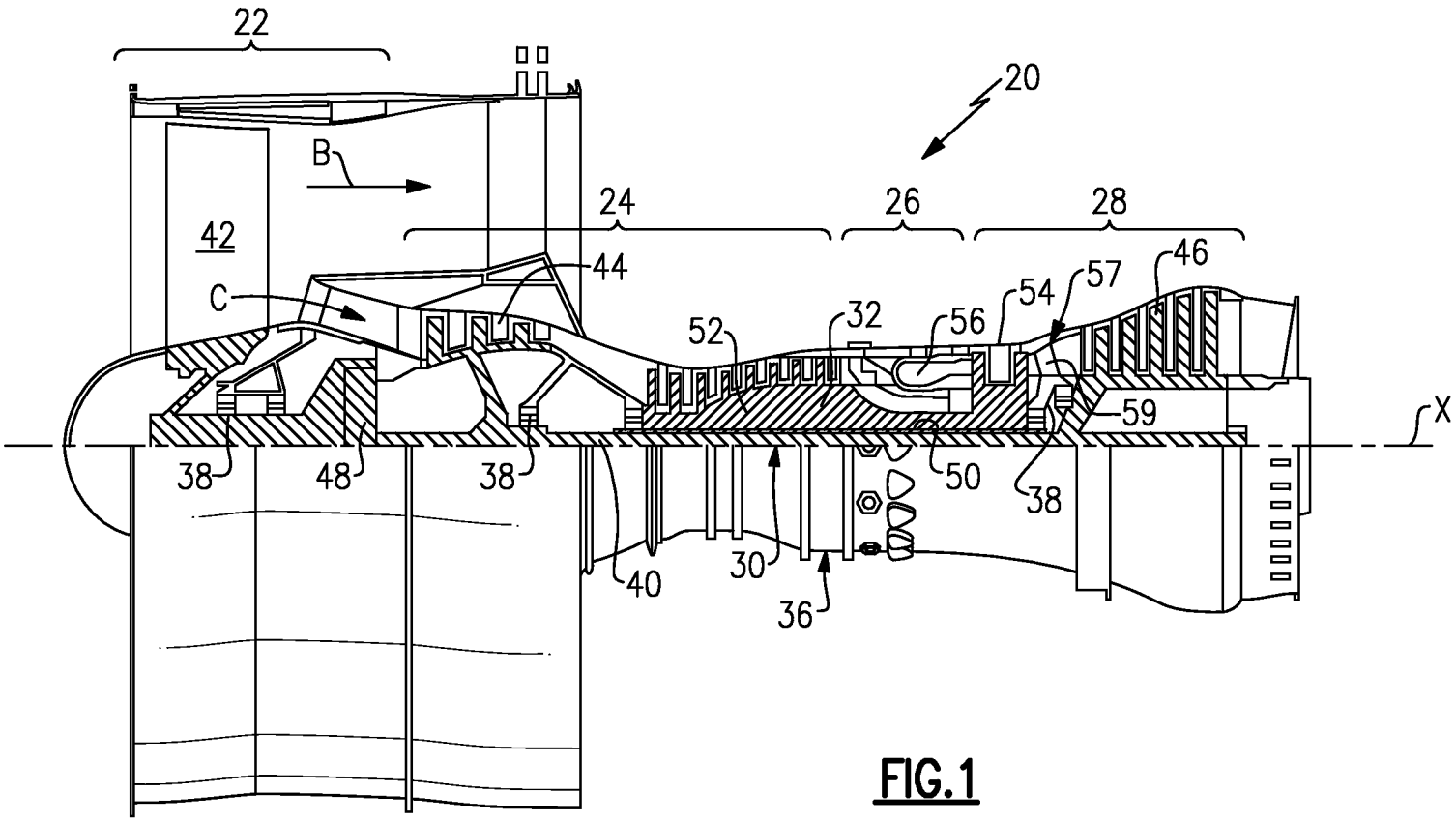
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath B while the compressor section 24 drives air along a core flowpath C (as shown in FIG. 2) for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 supports one or more bearing systems 38 in the turbine section 28. The inner shaft 40 and the outer shaft 50 are concentric and rotate via bearing systems 38 about the engine central longitudinal axis A, which is collinear with their longitudinal axes.

The core airflow C is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The disclosed serpentine cooling passage may be used in various gas turbine engine components. For exemplary purposes, a turbine blade 64 is described. It should be understood that the cooling passage may also be used in vanes, blade outer air seals, and turbine platforms, for example.

Figure 2A:
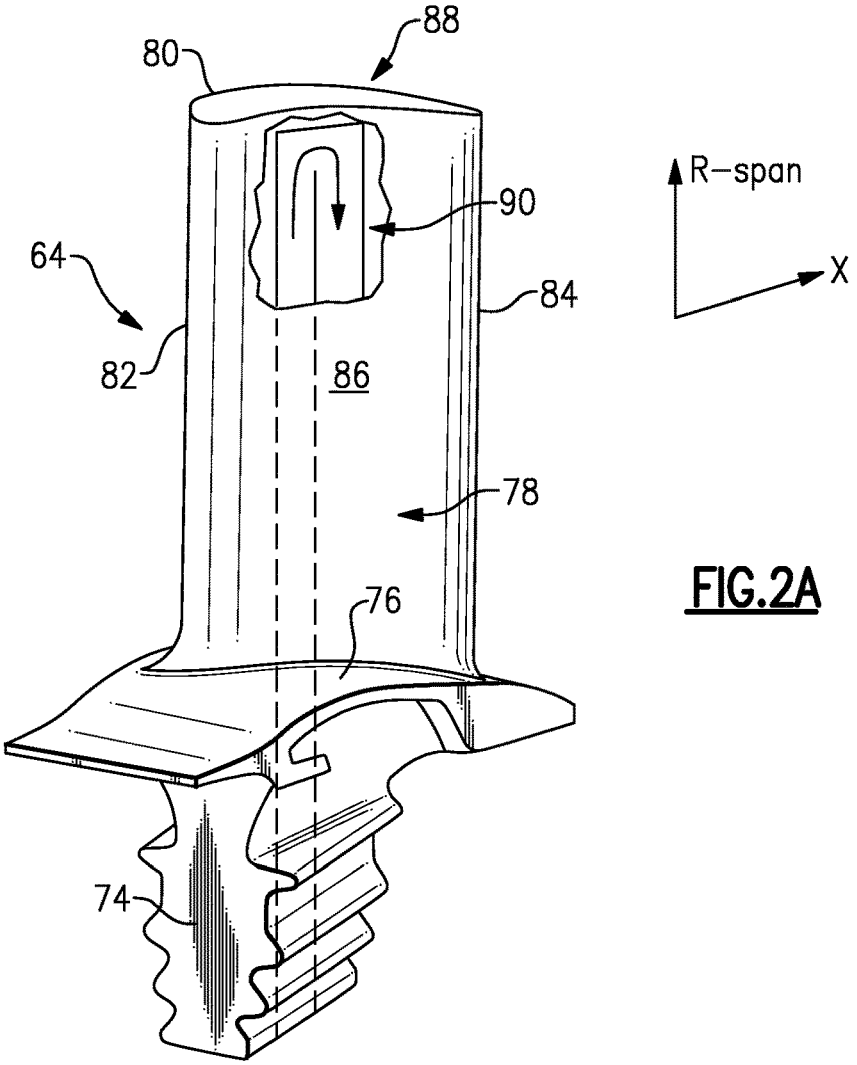
FIG. 2A is a perspective view of the airfoil having the disclosed cooling passage.
Figure 2B:
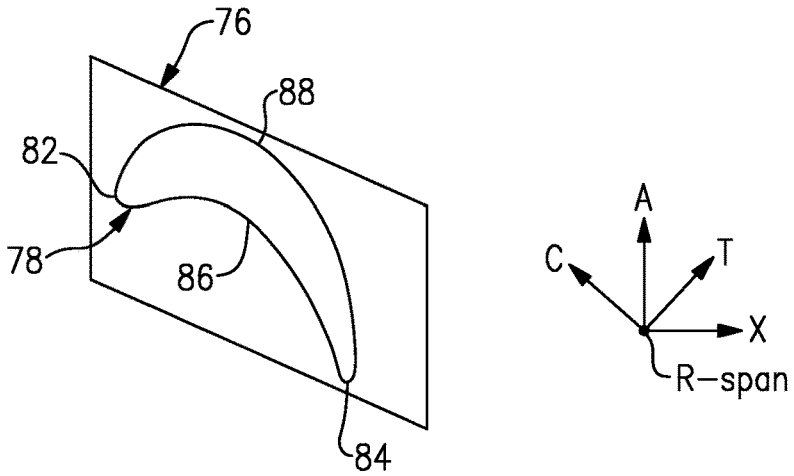
FIG. 2B is a plan view of the airfoil illustrating directional references.

Referring to FIGS. 2A and 2B, a root 74 of each turbine blade 64 is mounted to the rotor disk. The turbine blade 64 includes a platform 76, which provides the inner flow path, supported by the root 74. An airfoil 78 extends in a radial direction R from the platform 76 to a tip 80. It should be understood that the turbine blades may be integrally formed with the rotor such that the roots are eliminated. In such a configuration, the platform is provided by the outer diameter of the rotor. The airfoil 78 provides leading and trailing edges 82, 84. The tip 80 is arranged adjacent to a blade outer air seal (not shown).

The airfoil 78 of FIG. 2B somewhat schematically illustrates exterior airfoil surface extending in a chord-wise direction C from a leading edge 82 to a trailing edge 84. The airfoil 78 is provided between pressure (typically concave) and suction (typically convex) wall 86, 88 in an airfoil thickness direction T, which is generally perpendicular to the chord-wise direction C. Multiple turbine blades 64 are arranged circumferentially in a circumferential direction A. The airfoil 78 extends from the platform 76 in the radial direction R, or spanwise, to the tip 80.

The airfoil 78 includes multiple cooling passages 90 provided between the pressure and suction walls 86, 88. The exterior airfoil surface may include multiple film cooling holes (not shown) in fluid communication with the cooling passage 90. Flow through the cooling passage 90 illustrated in FIG. 2A is shown in more detail in FIG. 3.

Figure 3:
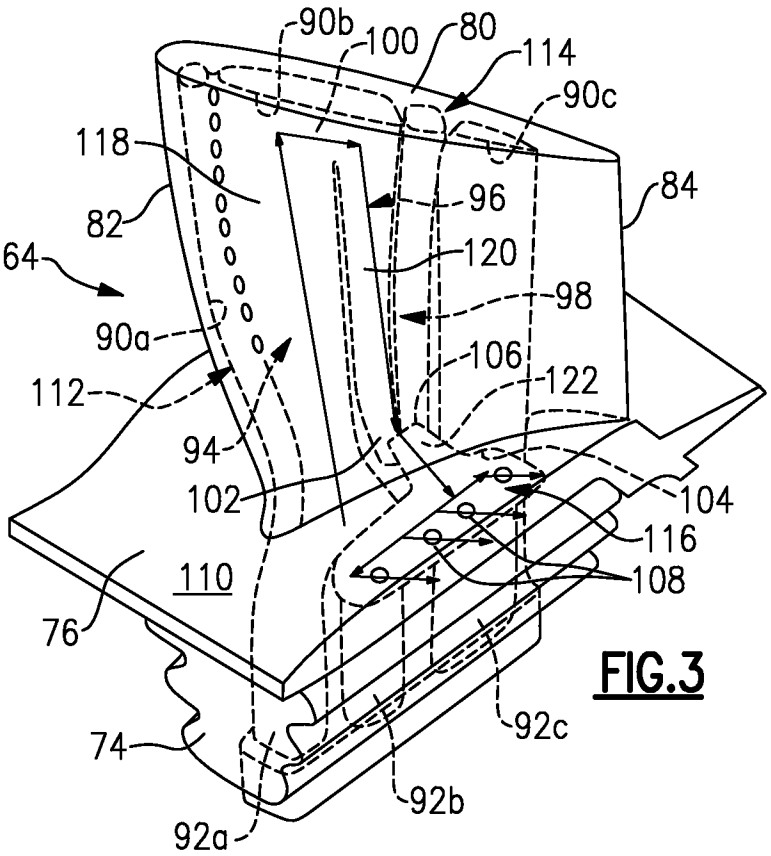
FIG. 3 is a perspective view of an example airfoil having a serpentine cooling passage, with the cooling passages and core shown in phantom.

Referring to FIG. 3, a core 112 is shown in phantom within the turbine blade 64. The core 112 produces correspondingly shaped passages within the turbine blade using known casting techniques. Alternatively, the airfoil 64 may be constructed using an additive manufacturing technique in which the cooling passages are formed while constructing the blade layer-by-layer.

Figure 4:
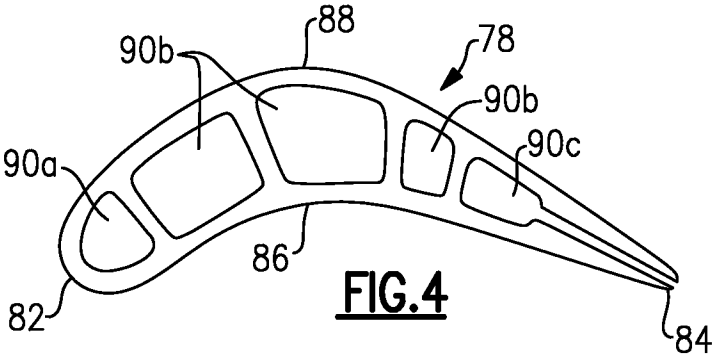
FIG. 4 is a cross-sectional view of the airfoil shown in FIG. 2A taken along line 4-4.

The turbine blade 64 includes multiple cooling passages 90A, 90B, 90C. The cooling passage 90A corresponds to a leading edge cooling passage, and the cooling passage 90C corresponds to a trailing edge cooling passage. In one type of cooling configuration, a serpentine cooling passage 90B is provided in the mid-body section of the airfoil 78 between the leading and trailing edge cooling passages 90A, 90C, as shown in FIG. 4. In one example, each of the cooling passages 90A, 90B, 90C is fed by discrete inlets 92A, 92B, 92C, respectively, which are joined at a sprue (FIG. 3) for handling during the casting process.

Figure 5:
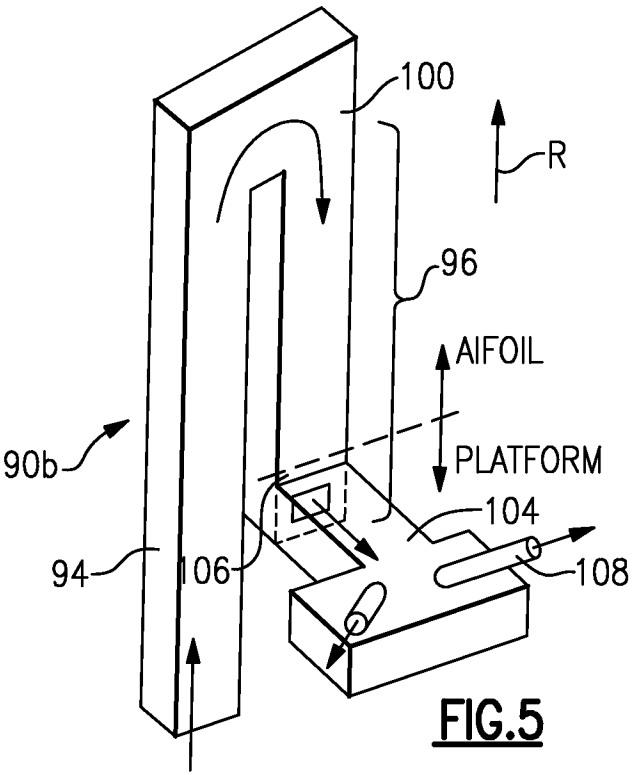
FIG. 5 is a schematic perspective view of an example serpentine cooling passage with a platform cooling passageway.

Typically, a serpentine cooling passage 90B has at least one up-pass connected to at least one down-pass interconnected to one another by a bend to provide a U-shaped passage, as shown in FIGS. 3 and 5. In the example shown, the cooling passage 90B includes a first passageway 94 extending radially outward from the inlet 92B toward an end, in the example, the tip 80. A second passageway 96 is interconnected to the first passageway 94 at a first bend 100 and extends radially downward away from the tip 80 toward the platform 76. In one example, a third passageway 98 is interconnected to the second passageway 96 at a second bend 102 and extends radially upward from the platform 76 toward the tip where the passageway terminates.

The mid-body of the airfoil 78 may be susceptible to developing a hot spot if the pumping action of the fluid is ineffective. Thus, the disclosed cooling configuration provides a cooling flow exit at a location on the turbine blade 64 with a low dump pressure, which ensures that the fluid continues to flow through the serpentine cooling passage 90B. To this end, a platform passageway 104 is arranged within the platform 76 and is fluidly interconnected to the second passageway 96 at an end 106, which is generally arranged near the second bend 102 in the example. The platform passageway 104 is generally normal to the second passageway 94. At least one cooling hole 108 fully connects the platform passageway 104 to an exterior surface 110 to provide an exit for the cooling flow near the inner gas flow path, which has a relatively low pressure as compared to the fluid pressure at the inlet 92B. The cooling holes 108 may be any suitable shape, for example, slots, circular, non-circular, linear, non-linear and others. The exterior surface 110 may be provided in on the platform and or blade necks, for example.

The core 112 includes a serpentine core 114 providing the first, second and third passageways 94, 96, 98. The core 112 also includes a platform core 116 corresponding to the platform passageway 104. The serpentine core portion 114 includes an up-pass portion 118 and a down-pass portion 120 that respectively provide the first and second passageways 94, 96. The platform core portion 116 is interconnected to the down pass portion 120 at an intersection 122.

In one an example, the platform passageway 104 is generally perpendicular to the second passageway 96. The first, second and third passageways 94, 96, 98 extend in a radial direction and the platform passageway 104 extends in the circumferential direction A. The serpentine cooling passage 90B may be provided by any number of passes. For example, two passes are shown in FIG. 5 and three passes are shown in FIG. 3.

Figure 6:
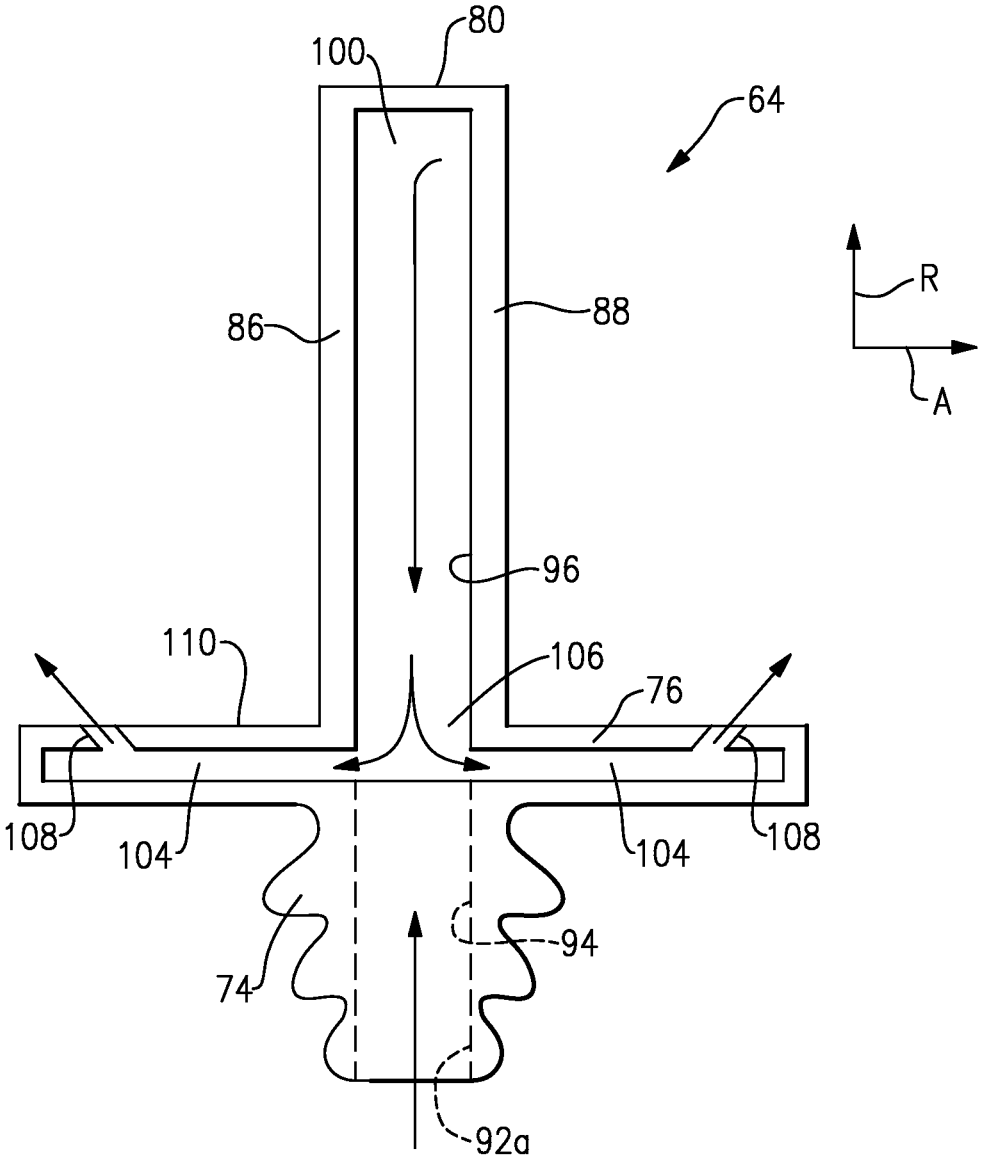
FIG. 6 is a schematic view of a turbine blade illustrating a serpentine cooling passageway feeding fluid to platform cooling passageways having cooling holes.

A platform passageway may be provided on either or both of the pressure and suction side portions of the platform 76, as shown in FIG. 6.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although example embodiments have been disclosed, a worker of ordinary skill in this art would recognize that certain modifications would come within the scope of the claims. For that and other reasons, the following claims should be studied to determine their true scope and content.

What is claimed is:

1. A core for a gas turbine engine airfoil comprising:

a serpentine core portion configured to provide an inlet extending to a first passageway, and a second passageway fluidly connected to the first passageway to form a U-shaped cooling passage, wherein the first and second passageways provide an up-pass passageway and a down-pass passageway that form the U-shaped cooling passage, wherein the first and second passageways are spaced apart from one another in a chord-wise direction, the serpentine cooling passage terminates at the platform at a second passageway end of the U-shaped cooling passage; and a platform core portion configured to provide a platform cooling passageway arranged transverse and connected to the second passageway, wherein the platform cooling passageway is configured to extend along a pressure side of the platform, wherein the platform cooling passageway is configured to extend along a suction side of the platform, or wherein the platform cooling passageway is configured to extend along a pressure side and a suction side of the platform; and wherein the platform cooling passageway has a first portion that extends generally circumferentially from the second passageway end to a second portion that extends generally axially.

2. The core for a gas turbine engine airfoil according to claim 1, wherein the first passageway is an up-pass passageway and the second passageway is a down-pass passageway, the down-pass passageway terminates near the platform cooling passageway.

3. The core for a gas turbine engine airfoil according to claim 1, wherein the first passageway is an up-pass passageway and the second passageway is a down-pass passageway, the platform cooling passageway is generally normal to the down-pass passageway.

4. The core for a gas turbine engine airfoil according to claim 1, wherein the platform core portion extends in opposite directions from serpentine core portion.

5. The core for a gas turbine engine airfoil according to claim 1, comprising multiple cooling holes fluidly connecting the platform cooling passageway to an exterior airfoil surface, wherein the cooling holes extend generally radially outward from the second portion.

6. The core for a gas turbine engine airfoil according to claim 1, wherein the first and second portions of the platform cooling passageway form a T shape.

7. The core for a gas turbine engine airfoil according to claim 1, wherein the second portion of the platform cooling passageway extends axially forward and aft of the first portion.

* * * * *